US010281841B2

(12) United States Patent
Chuang et al.

(10) Patent No.: US 10,281,841 B2
(45) Date of Patent: May 7, 2019

(54) TONER CARTRIDGE

(71) Applicant: GENERAL PLASTIC INDUSTRIAL CO., LTD., Taichung (TW)

(72) Inventors: Chin-His Chuang, Taichung (TW); Zheng-Yi Xiao, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/492,679

(22) Filed: Apr. 20, 2017

(65) Prior Publication Data

US 2018/0143565 A1 May 24, 2018

(30) Foreign Application Priority Data

Nov. 23, 2016 (CN) ..... 2016 2 1257954 U

(51) Int. Cl.
*G03G 15/08* (2006.01)

(52) U.S. Cl.
CPC ..... *G03G 15/0872* (2013.01); *G03G 15/0891* (2013.01); *G03G 2215/0668* (2013.01); *G03G 2215/0675* (2013.01); *G03G 2215/085* (2013.01)

(58) Field of Classification Search
None
See application file for complete search history.

(56) References Cited

U.S. PATENT DOCUMENTS

2005/0117918 A1* 6/2005 Kimura ..... G03G 15/553 399/8
2016/0033898 A1* 2/2016 Yamabe ..... G03G 15/0872 399/258

* cited by examiner

*Primary Examiner* — Roy Y Yi
(74) *Attorney, Agent, or Firm* — Muncy, Geissler, Olds & Lowe, P.C.

(57) ABSTRACT

A toner cartridge includes a cylinder having an opening and accommodating carbon powder, a transmission member having a pipe portion sleeved onto the cylinder, an end portion and at least one outlet communicating with the opening, a powder guiding member having a main body disposed at the end portion and blades extended from the main body radially, a powder storing cover having a cover body sleeved onto the pipe portion, a powder exiting passage located under the powder guiding member and a powder exit provided on the bottom side of the cover body and communicating with the powder exiting passage, and a spring. As a result, when the blades stir the spring, the carbon powder accumulating in the powder exiting passage can be vibrated, so the carbon powder remaining near the powder exit can be effectively reduced and the powder exit can be prevented from being blocked.

15 Claims, 8 Drawing Sheets

TONER CARTRIDGE

BACKGROUND OF THE INVENTION

1. Field of the Invention

The present invention relates to electronic imaging devices and more particularly, to a toner cartridge for an electronic imaging device.

2. Description of the Related Art

In an electronic imaging device such as a copy machine, a printer or a fax machine, one of the most important components is the toner cartridge, which is the technical core of the development of the electronic imaging device. At present, there are various designs for toner cartridge in the industry, wherein some designs are primarily for the purpose of enabling the toner cartridge to discharge the carbon powder therein as completely as possible, which is taken as the most important consideration in the structural design of these toner cartridges. However, to achieve the aforesaid purpose, some toner cartridges are very complicated in structure and need a collocation or combination of multiple elements to reduce the remanent powder in the toner cartridge as much as possible. In such condition, the assembly of the toner cartridge consumes relatively more time, and false actions such as the elements being locked by each other are liable to happen in practical operation of the toner cartridge, disabling the toner cartridge from discharging carbon powder successfully.

SUMMARY OF THE INVENTION

The present invention has been accomplished in view of the above-noted circumstances. It is an objective of the present invention to provide a toner cartridge which is simple in structure, convenient and fast in assembly, and capable of reducing the carbon powder remaining near the powder exit and preventing the powder exit from being blocked.

To attain the above objective, the present invention provides a toner cartridge which includes a cylinder, a transmission member, a powder guiding member, a powder storing cover, and a spring. The cylinder has an opening communicating with interior and exterior of the cylinder. The transmission member has a pipe portion sleeved onto the cylinder, a gear ring provided on the periphery of the pipe portion, an end portion provided at a free end of the pipe portion, and at least one outlet provided at the end portion and communicating with the opening. The powder guiding member has a main body fixed to the end portion of the transmission member, and a plurality of blades extended from the main body radially. The powder storing cover has a cover body sleeved onto the pipe portion of the transmission member to close the outlet, a powder exiting passage provided at the cover body and located under the powder guiding member, and a powder exit provided on the bottom side of the cover body and communicating with the powder exiting passage. The spring is at least partially accommodated in the powder exiting passage.

The toner cartridge is simple in structure, and convenient and fast in assembly. Besides, when the blades stir the spring, the carbon powder accumulating in the powder exiting passage is loosened by the vibration caused by the spring, thereby discharged through the powder exit, so that the carbon powder remaining near the powder exit can be effectively reduced and the powder exit can be prevented from being blocked.

DETAILED DESCRIPTION OF THE INVENTION

Figure 1:
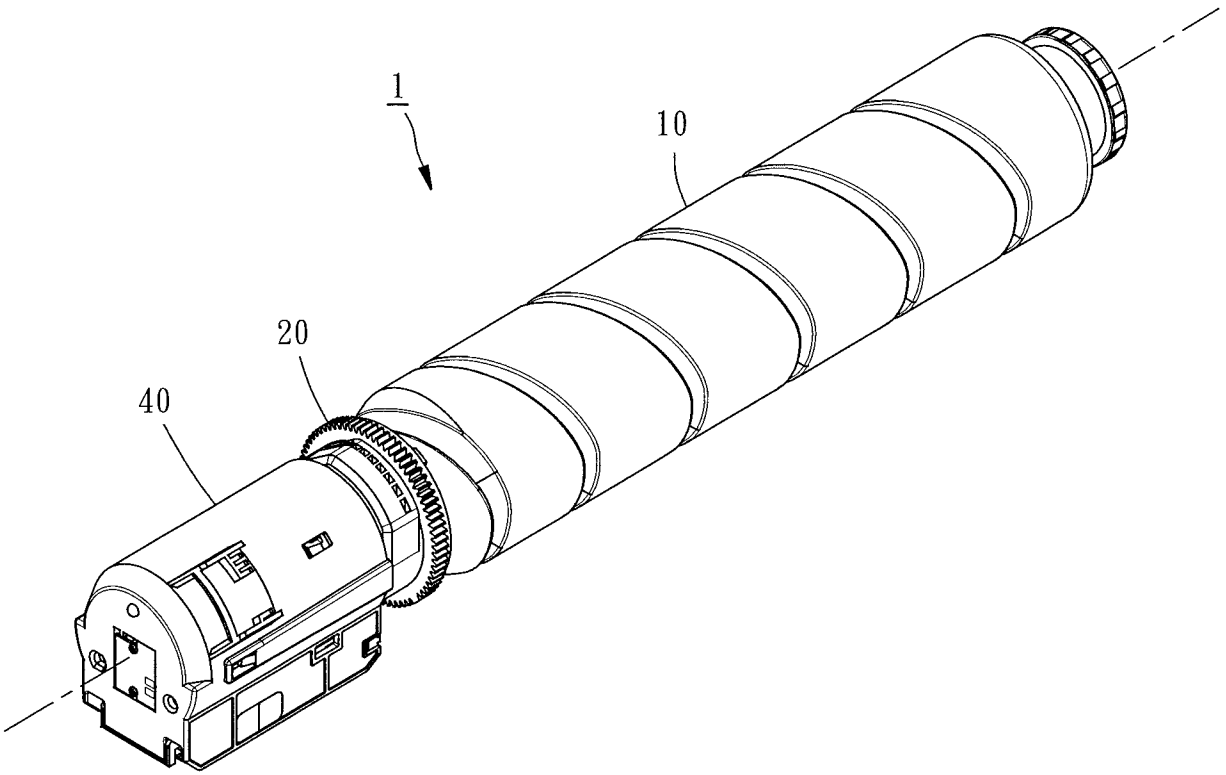
FIG. 1 is an assembled perspective view of a toner cartridge according to a first preferred embodiment of the present invention.
Figure 2:
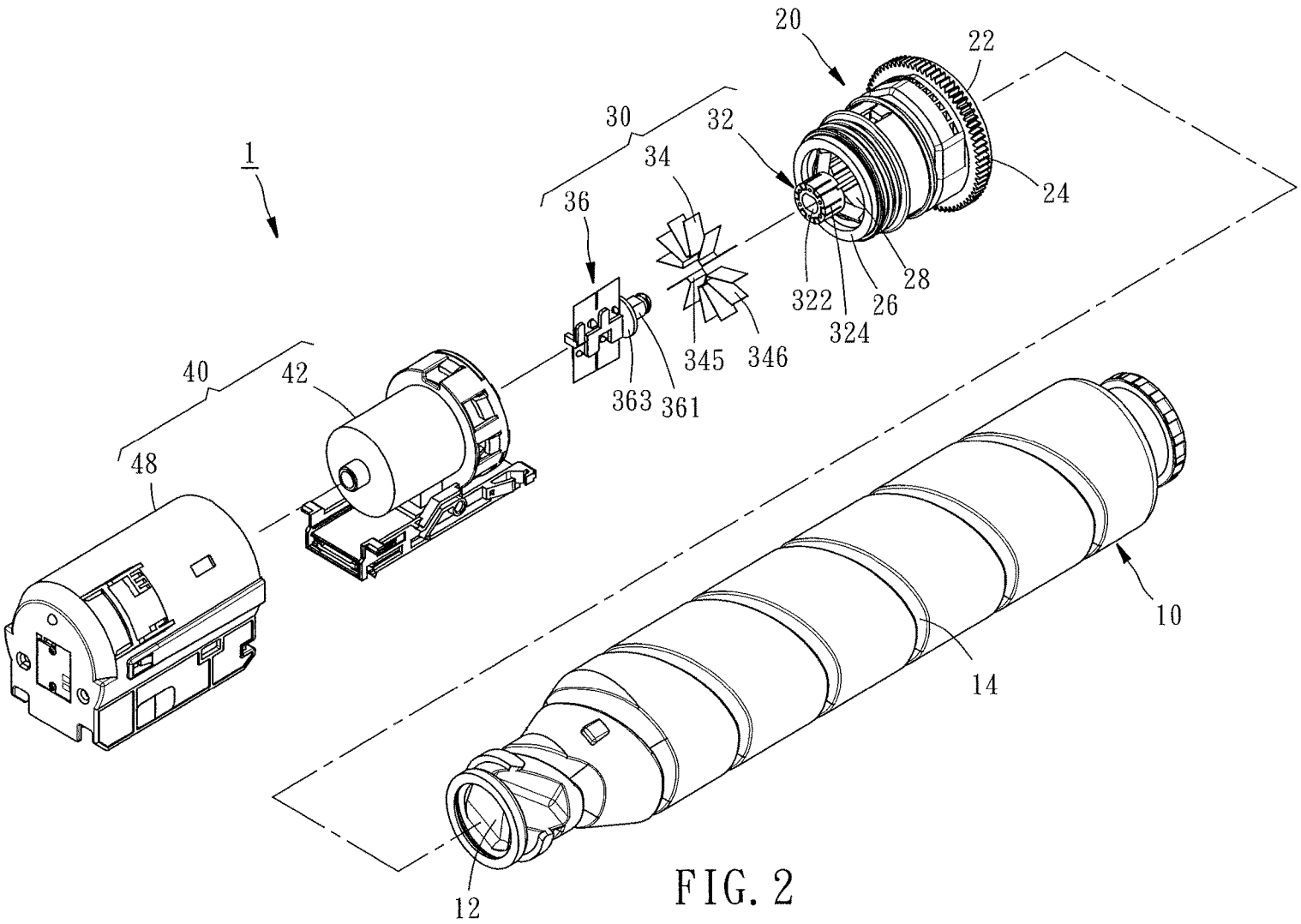
FIG. 2 is an exploded perspective view of the toner cartridge according to the first preferred embodiment of the present invention.
Figure 3:
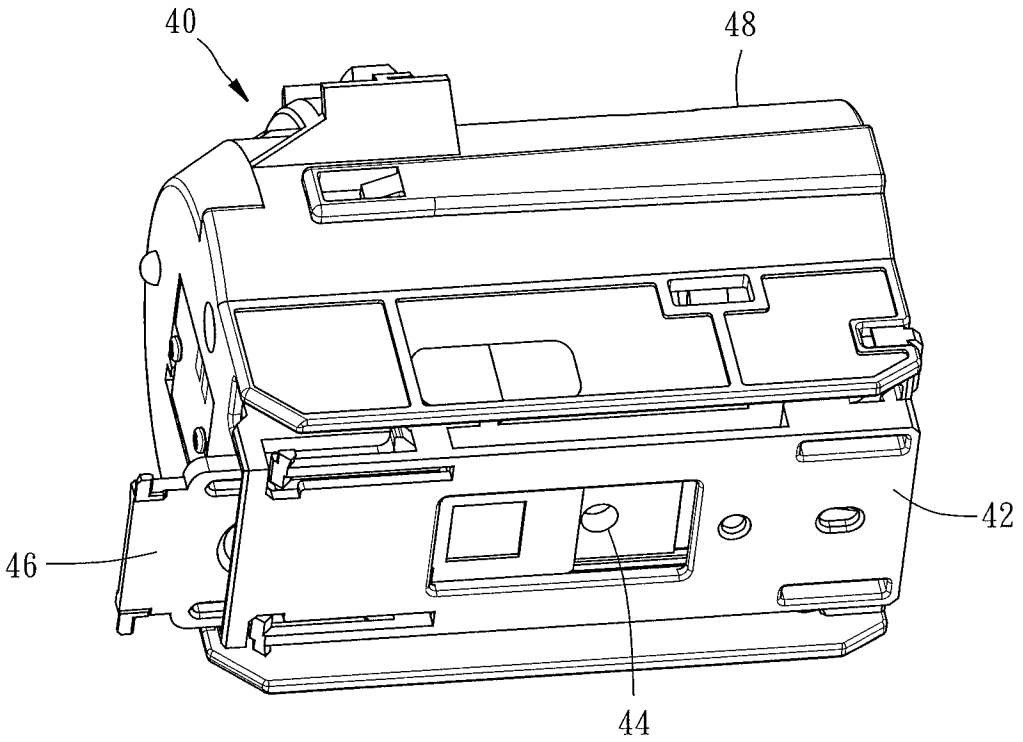
FIG. 3 is a perspective view of a powder storing cover according to the first preferred embodiment of the present invention.
Figure 4:
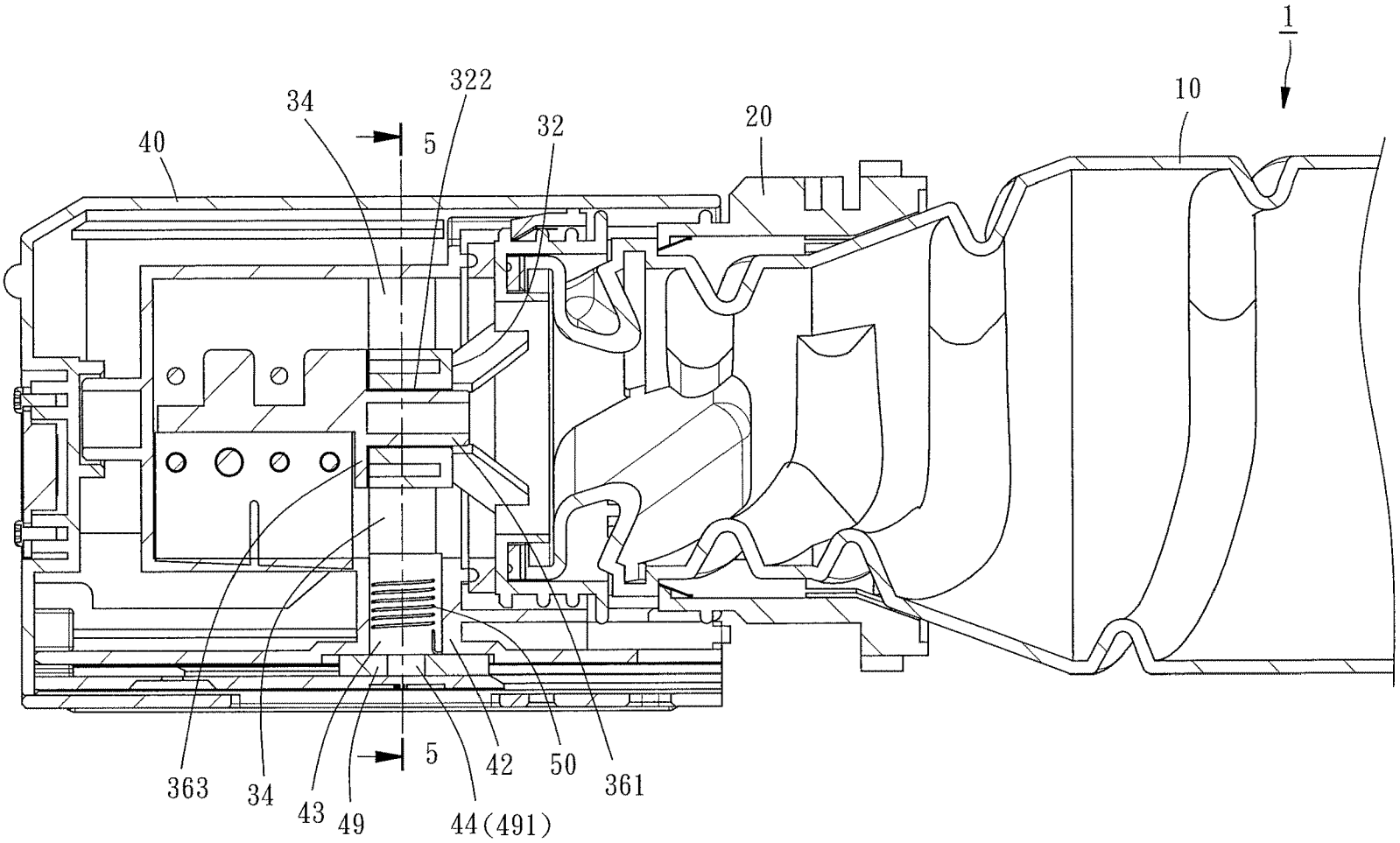
FIG. 4 is a sectional view of a part of the toner cartridge according to the first preferred embodiment of the present invention.

Referring to FIGS. 1-6, a toner cartridge 1 according to a first preferred embodiment of the present invention includes a cylinder 10, a transmission member 20, a powder guiding member 30, a powder storing cover 40, and a spring 50. The toner cartridge 1 is adapted to be disposed in an electronic imaging device (not shown).

The cylinder 10 has an opening 12 communicating with interior and exterior of the cylinder, and a thread 14. The aforesaid interior refers to the internal space of the cylinder 10 itself. The aforesaid exterior refers to the space outside of the cylinder 10. The internal space of the cylinder 10 is adapted for accommodating carbon powder. The thread 14 is concaved from a part of the external surface of the cylinder 10 to the internal space of the cylinder 10. The opening 12 is provided for the carbon powder to pass therethrough.

The transmission member 20 has a pipe portion 22 sleeved onto the cylinder 10, a gear ring 24 provided on the periphery of the pipe portion 22, an end portion 26 provided at a free end of the pipe portion 22, and four outlets 28 provided at the end portion 26 for the carbon powder to pass therethrough. The outlets 28 are located adjacent to the opening 12 of the cylinder 10 so that the outlets 28 communicate with the opening 12 and the internal space of the cylinder 10. The gear ring 24 is adapted for being engaged with a driving gear (not shown) of the electronic imaging device. The transmission member 20 can be driven to rotate in a way that the gear ring 24 is rotated by the driving gear. The cylinder 10 and the transmission member 20 are fixed to each other, thereby rotatable together. In other embodiments, the amount of the outlets 28 can be modified according to demands.

The powder guiding member 30 has a main body 32 disposed at the end portion 26 of the transmission member 20, a plurality of blades 34 extended from the main body 32 radially, and a plug member 36 connected with the main body 32. In this embodiment, the main body 32 is integrally extended from the end portion 26 of the transmission member 20. The blades 34 are made of elastic material, and the terminal ends of the blades 34 are abutted against the inner wall of the powder storing cover 40. The plug member 36 has a rod portion 361, and a plate portion 363 provided at an end of the rod portion 361. The main body 32 has an axial hole 322 for the rod portion 361 of the plug member 36 to be inserted therein, and a plurality of embedding grooves 324 concaved from a free end of the main body 32 for the blades 34 to be inserted in the embedding grooves 324. The cross sections of the axial hole 322 and the rod portion 361 are not circular, so the plug member 36 will not rotate relative to the main body 32. The plate portion 363 of the plug member 36 is abutted on the free end of the main body 32 to prevent the blades 34 from escaping from the embedding grooves 324. The embedding grooves 324 are U-shaped at the free end of the main body 32, and each of the blades 34 has a U-shaped inserting portion 345 located in the embedding groove 324 and two wing portions 346 extended from two ends of the inserting portion 345. In this way, the blades 34 will not escape from the main body 32 along its radial direction. Because of being connected with the transmission member 20, the powder guiding member 30 can rotate along with the transmission member 20 and the cylinder 10. In other embodiments, the blades 34 can be modified in amount.

Figure 6:
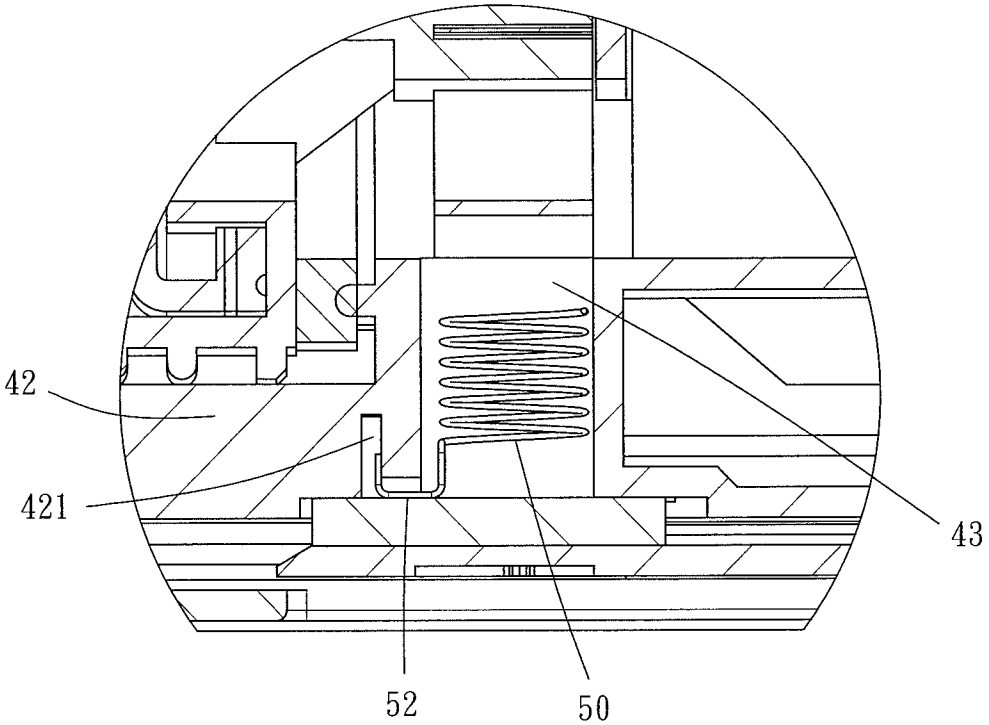
FIG. 6 is a sectional view of another part of the toner cartridge according to the first preferred embodiment of the present invention.

The powder storing cover 40 has a cover body 42 sleeved onto at least a part of the pipe portion 22 of the transmission member 20 to close the four outlets 28 of the transmission member 20, a powder exiting passage 43 provided on the cover body 42 and located under the powder guiding member 30, a powder exit 44 provided on the bottom side of the cover body 42 and communicating with the powder exiting passage 43, a sliding piece 46 slidably disposed at the cover body 42 for opening or closing the powder exit 44, an outer shell 48 covering parts of the cover body 42, and a pad 49 disposed on the bottom side of the cover body 42. The cover body 42 defines an internal space therein. The powder guiding member 30 is located in the internal space of the powder storing cover 40. The aforesaid to close the four outlets 28 means that after the carbon powder passes through the outlets 28, it is temporarily kept in the internal space of the powder storing cover 40. The outer shell 48 of the powder storing cover 40 is fixed to the electronic imaging device and not going to rotate. The cover body 42 has a groove 421 as shown in FIG. 6. In this embodiment, the groove 421 is L-shaped, but unlimited thereto. The pad 49 has a through hole 491 which forms the powder exit 44. In this embodiment, the pad 49 is made of foam sponge, but unlimited thereto. Viewed from the direction shown in FIG. 3, when the sliding piece 46 slides to the left to open the powder exit 44, the toner cartridge 1 can discharge the carbon powder through the powder exit 44; when the sliding piece 46 slides to the right to close the powder exit 44, the carbon powder is preserved in the toner cartridge 1.

The spring 50 is at least partially accommodated in the powder exiting passage 43 and connected with the cover body 42. In this embodiment, the spring 50 is provided at an end thereof with a hook portion 52 which is inserted in the groove 421, and the bottom edge of the hook portion 52 is abutted on the pad 49. In this way, the spring 50 is positionally limited, and will not escape from the powder exiting passage 43.

Figure 5:
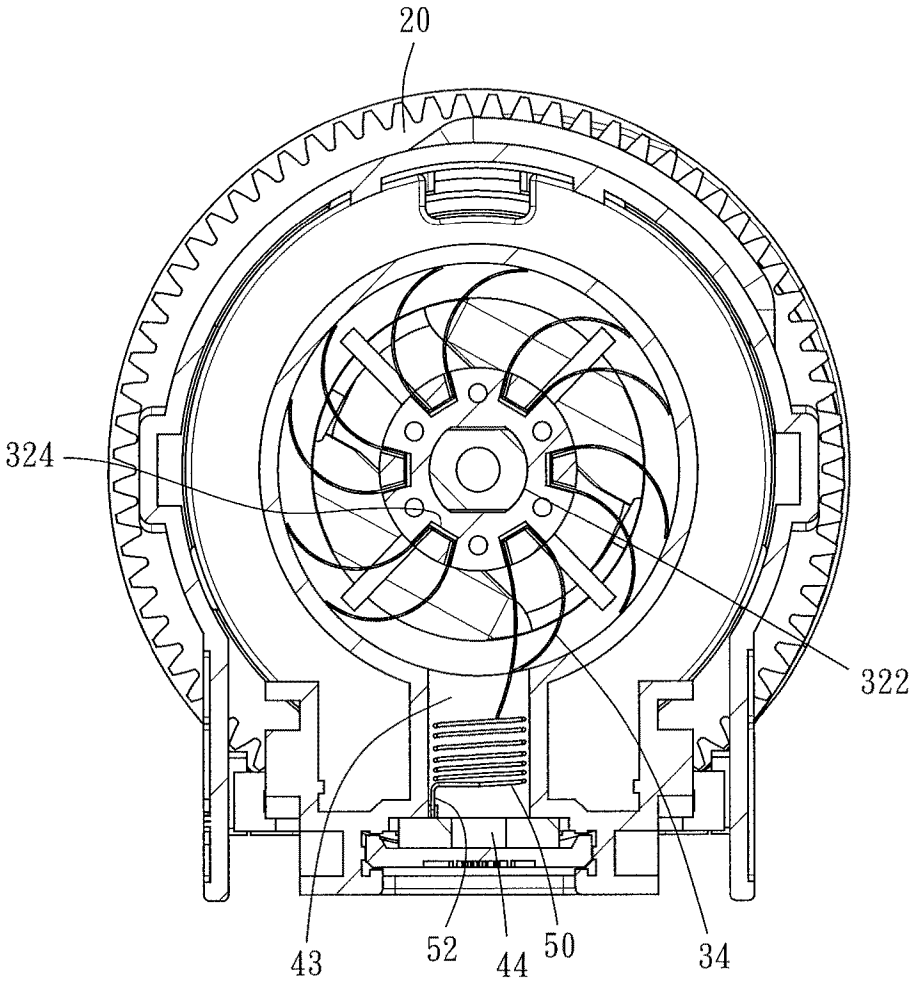
FIG. 5 is a sectional view taken along the line 5-5 in FIG. 4.

When the toner cartridge 1 is installed in the electronic imaging device and operates, the driving gear of the electronic imaging device drives the transmission member 20, the cylinder 10 and the powder guiding member 30 to rotate together, and the powder storing cover 40 is not rotated. During the rotation of the cylinder 10, the carbon powder located in the cylinder 10 is gradually moved to the opening 12 by the rotation of the thread 14. The carbon powder leaves the cylinder 10 through the opening 12, and then enters the internal space of the powder storing cover 40 through the outlets 28. The carbon powder located in the powder storing cover 40 is driven by the rotation of each blade 34 of the powder guiding member 30 to move to the powder exiting passage 43 of the powder storing cover 40. As shown in FIG. 5, the blades 34 are elastic and a little bendedly abutted against the inner wall of the powder storing cover 40. Therefore, when anyone of the blades 34 is rotated to the position above the powder exiting passage 43, the elasticity of the blade 34 can be released so that the blade 34 can be inserted in the powder exiting passage 43 to contact the spring 50. The carbon powder accumulating in the powder exiting passage 43 can be loosened by the vibration caused by the spring 50 being flapped by the blade 34, thereby discharged through the powder exit 44. As a result, the carbon powder can be continuously and regularly discharged by the toner cartridge 1 through the powder exit 44 to be used by the electronic imaging device. Besides, the toner cartridge 1 is simple in structure, convenient and fast in assembly, and capable of reducing the carbon powder remaining in the powder exiting passage 43 effectively and preventing the powder exit 44 from being blocked.

Figure 7:
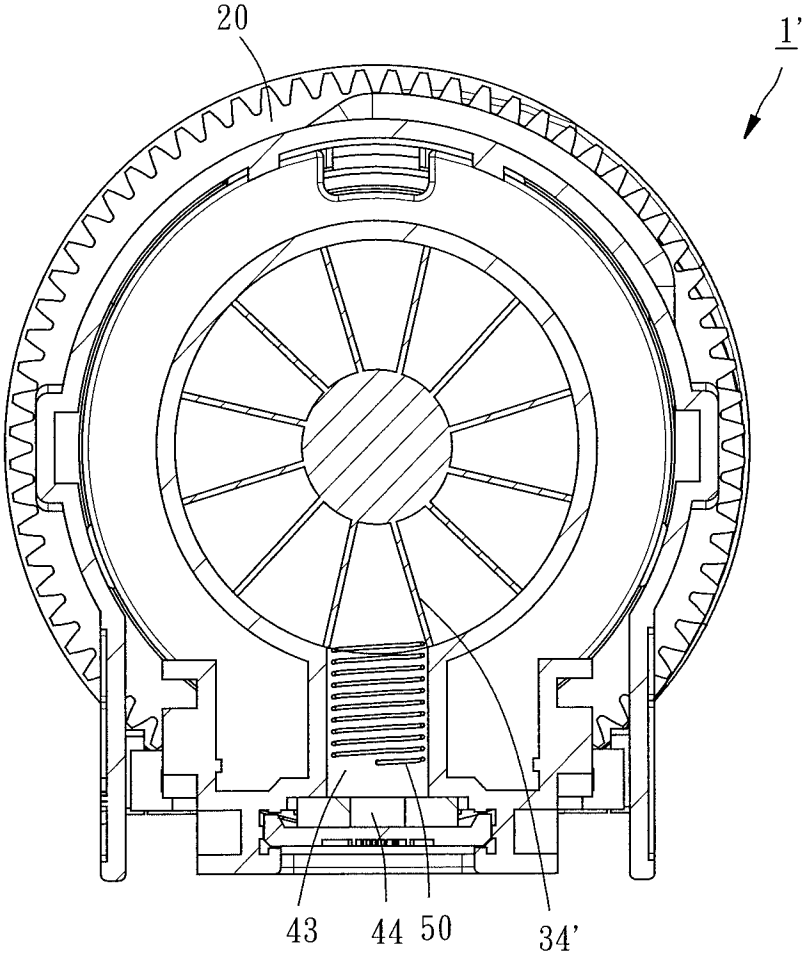
FIG. 7 is a sectional view of a toner cartridge according to a second preferred embodiment of the present invention.
Figure 8:
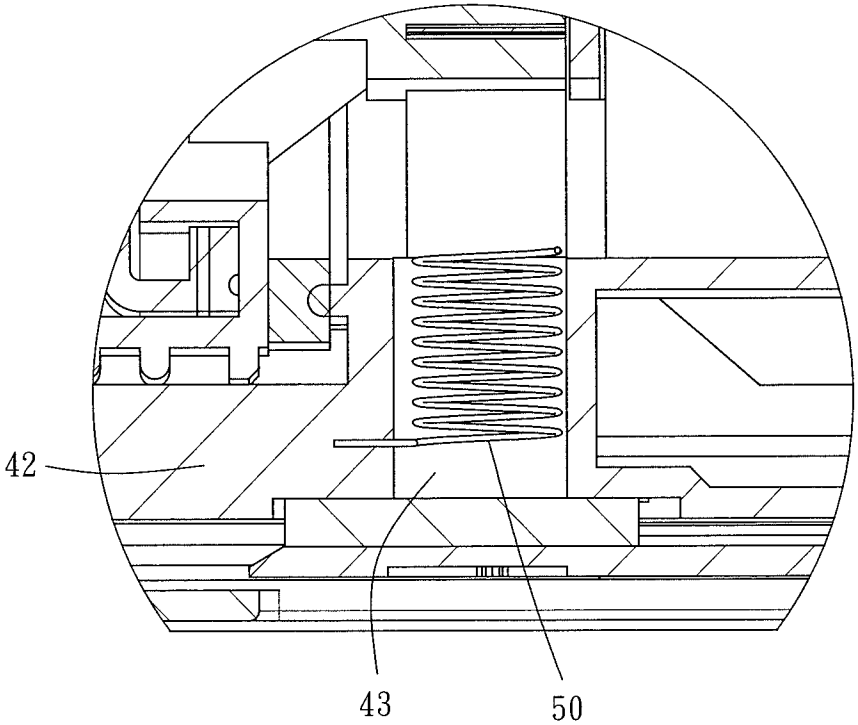
FIG. 8 is another sectional view of a part of the toner cartridge according to the second preferred embodiment of the present invention.

As shown in FIGS. 7-8, the toner cartridge 1' according to a second preferred embodiment of the present invention is approximately the same with the toner cartridge 1 according to the first preferred embodiment of the present invention in structure, and the difference therebetween is that the blades 34' of the toner cartridge 1' are not elastic and thereby not a little bendedly abutted against the inner wall of the powder storing cover 40. In such case, the top end of the spring 50 is protruded out of the powder exiting passage 43 in a way that the terminal ends of the blades 34' are able to be in contact with the spring 50. In this way, the blade 34' being rotated to the position above the powder exiting passage 43 can still flap the spring 50 to cause the spring 50 to vibrate the carbon powder. Besides, the first and second preferred embodiments are also different in the manner of connecting the spring 50 with the cover body 42. Referring to FIG. 8, an end of the spring 50 is inserted in the inner wall of the powder exiting passage 43 so that the spring 50 is fixed to the cover body 42. In fact, the manner of connecting the spring 50 with the cover body 42 still has other modifications. For example, the spring 50 can be just accommodated in the powder exiting passage 43 and not inserted or fixed to the cover body 42. In such case, the spring 50 can displace in the powder exiting passage 43 between the pad 49 and the blades 34 and 34'. In other embodiments, the manner of connecting the spring 50 with the cover body 42 can be modified according to demands, as long as the spring 50 is prevented from escaping from the powder exiting passage 43.

Based on the spirit of the present invention, the structure of the toner cartridge 1 and 1' may be modified. For example, the transmission member 20 may be not fixed to the cylinder 10; the transmission member 20 may be connected with a powder delivering rod (not shown) located in the cylinder 10; when the transmission member is driven to rotate, the powder delivering rod, which has spiral blades, can move the carbon powder located in the cylinder 10 to the opening 12. Besides, the powder guiding member 30 may be modified in the shape of the blades 34 or the structure depending on demands, as long as the blades 34 can push the carbon powder located in the powder storing cover 40 to the powder exiting passage 43. The powder guiding member 30 may be connected with the transmission member 20 in other ways, such as by engaging or gluing, as long as the powder guiding member 30 and the transmission member 20 are fixed to each other and thereby rotatable together. The blades 34 and the embedding grooves 324 may be modified in shape depending on demands, as long as the blades 34 will not escape from the embedding grooves 324. For example, the blades 34 may be reverse-T-shaped and the embedding grooves 324 may be straight. The blades 34 may be fixed to the main body 32 of the powder guiding member 30 by means of other structures.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge comprising:

a cylinder having an opening communicating with interior and exterior of the cylinder;

a transmission member having a pipe portion sleeved onto the cylinder, a gear ring provided on a periphery of the pipe portion, an end portion provided at a free end of the pipe portion remote from the cylinder, and at least one outlet provided at the end portion and communicating with the opening;

a powder guiding member having a main body fixed to the end portion of the transmission member and located at the exterior of the cylinder, and a plurality of blades extended outwardly from the main body radially;

a powder storing cover having a cover body sleeved onto the pipe portion of the transmission member to close the outlet, a powder exiting passage provided at the cover body and located under the powder guiding member, and a powder exit provided on a bottom side of the cover body and communicating with the powder exiting passage; and a spring at least partially accommodated in the powder exiting passage.

2. The toner cartridge as claimed in claim 1, wherein the spring is connected with the cover body.

3. The toner cartridge as claimed in claim 2, wherein the cover body has a groove; the spring is provided at an end thereof with a hook portion inserted in the groove.

4. The toner cartridge as claimed in claim 3, wherein the powder storing cover further has a pad disposed on the bottom side of the cover body; the pad has a through hole forming the powder exit.

5. The toner cartridge as claimed in claim 2, wherein an end of the spring is inserted in an inner wall of the powder exiting passage.

6. The toner cartridge as claimed in claim 1, wherein the powder storing cover further has a pad disposed on the bottom side of the cover body; the pad has a through hole forming the powder exit.

7. The toner cartridge as claimed in claim 1, wherein the blades of the powder guiding member are made of elastic material.

8. The toner cartridge as claimed in claim 7, wherein terminal ends of the blades of the powder guiding member are abutted against the powder storing cover.

9. The toner cartridge as claimed in claim 8, wherein the blades of the powder guiding member are able to be inserted in the powder exiting passage and in contact with the spring.

10. The toner cartridge as claimed in claim 7, wherein the powder guiding member further has a plug member having a rod portion and a plate portion provided at an end of the rod portion; the main body has an axial hole, and a plurality of embedding grooves concaved from a free end of the main body; the rod portion of the plug member is inserted in the axial hole, and the blades are inserted in the embedding grooves; the plate portion of the plug member is abutted on the free end of the main body to prevent the blades from escaping from the embedding grooves.

11. The toner cartridge as claimed in claim 10, wherein the embedding grooves are U-shaped at the free end of the main body; each of the blades has an inserting portion which is U-shaped and located in the embedding groove, and two wing portions extended from two ends of the inserting portion.

12. The toner cartridge as claimed in claim 1, wherein a top end of the spring is protruded out of the powder exiting passage in a way that terminal ends of the blades of the powder guiding member are able to be in contact with the spring.

13. The toner cartridge as claimed in claim 1, wherein the main body of the powder guiding member is integrally extended from the end portion of the transmission member.

14. The toner cartridge as claimed in claim 1, wherein the powder guiding member further has a plug member having a rod portion and a plate portion provided at an end of the rod portion; the main body has an axial hole, and a plurality of embedding grooves concaved from a free end of the main body; the rod portion of the plug member is inserted in the axial hole, and the blades are inserted in the embedding grooves; the plate portion of the plug member is abutted on the free end of the main body to prevent the blades from escaping from the embedding grooves.

15. The toner cartridge as claimed in claim 14, wherein the embedding grooves are U-shaped at the free end of the main body; each of the blades has an inserting portion which is U-shaped and located in the embedding groove, and two wing portions extended from two ends of the inserting portion.

* * * * *